US005156769A

United States Patent [19]

Cha et al.

[11] Patent Number: 5,156,769

[45] Date of Patent: Oct. 20, 1992

[54] PHENYL MERCAPTOTETRAZOLE/TOLYL-TRIAZOLE CORROSION INHIBITING COMPOSITIONS

[75] Inventors: Charles Y. Cha, McMurray; Daniel P. Vanderpool, Coraopolis, both of Pa.

[73] Assignee: Calgon Corporation, Pittsburgh, Pa.

[21] Appl. No.: 540,597

[22] Filed: Jun. 20, 1990

[51] Int. Cl.[5] ..... C23F 11/14; C23F 11/16

[52] U.S. Cl. ..... 252/395; 252/394; 422/14; 422/16

[58] Field of Search ..... 422/16, 14; 252/395, 252/394, 397

[56] References Cited

U.S. PATENT DOCUMENTS

| | | | |
|---|---|---|---|
| 2,941,953 | 6/1960 | Hatch | 422/16 X |
| 3,342,749 | 9/1967 | Handleman | 252/395 X |
| 3,413,227 | 11/1968 | Howard et al. | 252/392 |
| 3,803,049 | 4/1974 | Korpics | 252/390 |
| 3,887,481 | 6/1975 | Korpics | 252/394 X |
| 3,985,503 | 10/1976 | O'Neal, Jr. | 422/7 |
| 4,149,969 | 4/1979 | Robitaille et al. | 422/16 |
| 4,184,991 | 1/1980 | Scheurman, III | 524/91 |
| 4,188,212 | 2/1980 | Fujiwara et al. | 430/69 |
| 4,202,796 | 5/1980 | Jacob et al. | 422/16 |
| 4,219,433 | 8/1980 | Manabe et al. | 422/16 |
| 4,338,209 | 7/1982 | Manabe et al. | 252/391 X |
| 4,406,811 | 9/1983 | Christensen | 422/16 X |
| 4,613,481 | 9/1986 | Gill et al. | 422/16 |
| 4,657,785 | 4/1987 | Kelly et al. | 422/16 |
| 4,668,474 | 5/1987 | Gill et al. | 422/16 |
| 4,675,158 | 6/1987 | Klindera | 252/391 |
| 4,686,059 | 8/1987 | Payerle | 422/16 |
| 4,728,452 | 3/1988 | Hansen | 422/16 |
| 4,744,950 | 5/1988 | Hollander | 422/16 |
| 4,873,139 | 10/1989 | Kinosky | 428/341 |

FOREIGN PATENT DOCUMENTS

| | | |
|---|---|---|
| 0173427 | 6/1985 | European Pat. Off. . |
| 2330340 | 1/1974 | Fed. Rep. of Germany . |
| 0008465 | 1/1980 | Japan . |
| 0142873 | 11/1981 | Japan . |
| 0152476 | 9/1982 | Japan . |

OTHER PUBLICATIONS

Chemical Abstract 95:47253(m) vol. 95.

Chemical Abstracts 95(6):47253m (1979).

*Primary Examiner*—Deborah L. Kyle

*Assistant Examiner*—Valerie Fee

*Attorney, Agent, or Firm*—W. C. Mitchell; C. M. Caruso

[57] ABSTRACT

A composition which is useful for inhibiting the corrosion of copper and copper alloy metals in contact with an aqueous system is disclosed. The composition comprises phenyl mercaptotetrazole and tolytriazole and/or benzotriazole.

17 Claims, No Drawings

PHENYL MERCAPTOTETRAZOLE/TOLYLTRIAZOLE CORROSION INHIBITING COMPOSITIONS

BACKGROUND OF THE INVENTION

Benzotriazole, mercaptobenzothiazole and tolyltriazole are well known copper corrosion inhibitors. For example, see U.S. Pat. No. 4,675,158 and the references cited therein. This patent discloses the use of tolyltriazole/mercaptobenzothiazole compositions as copper corrosion inhibitors. Also, see U.S. Pat. No. 4,744,950, which discloses the use of lower ($C_3$–$C_6$) alkylbenzotriazoles as corrosion inhibitors, and corresponding EPO application No. 85304467.5.

U.S. Pat. No. 4,338,209 discloses metal corrosion inhibitors which contain one or more of mercaptobenzothiazole, tolyltriazole and benzotriazole. Examples of formulations containing benzotriazole and tolyltriazole and formulations containing mercaptobenzothiazole and benzotriazole are given.

Copending patent application U.S. Ser. No. 348,521 relates to the use of higher alkylbenzotriazoles as copper and copper alloy corrosion inhibitors, and copending patent application U.S. Ser. No. 348,532 relates to the use of alkoxybenzotriazoles as copper and copper alloy corrosion inhibitors.

U.S. Pat. No. 4,406,811 discloses compositions containing a triazole such as tolyltriazole benzotriazole or mercaptobenzothiazole, an aliphatic mono- or di-carboxylic acid and a nonionic wetting agent.

U.S. Pat. No. 4,873,139 discloses the use of 1-phenyl-IH-tetrazole-5-thiol to prepare corrosion-resistant silver and copper surfaces. The use of 1-phenyl-5-mercaptotetrazole to inhibit the corrosion of carbon steel in nitric acid solutions is also known. See Chemical Abstract CA 95(6):47253 m (1979).

The present invention relates to compositions comprising: a) 1-phenyl-5-mercaptotetrazole, an isomer of 1-phenyl-5-mercaptotetrazole, a substituted phenyl mercaptotetrazole or a salt thereof; and b) a compound selected from the group consisting of tolyltriazole, benzotriazole and salts thereof, and the use of such compositions as corrosion inhibitors, particularly copper and copper alloy corrosion inhibitors. These compositions provide effective passivation of metallic surfaces, particularly copper and copper alloy surfaces, in contact with aqueous systems, and are especially effective in high dissolved solids water.

More particularly, the use of the instant compositions provides improved corrosion protection of copper-containing metals. As used herein the term "passivation" refers to the formation of a film on a metallic surface which is being protected from corrosion. "Passivation rate" refers to the time required to form a protective film on a metallic surface, and "persistency" refers to the length of time a protective film is present in the absence of a corrosion inhibitor. Also, the term "high solids water" refers to water which contains quantities of solids, particularly dissolved solids, in excess of about 1500 mg/L.

The instant compositions are not known or suggested in the art.

DESCRIPTION OF THE INVENTION

The present invention is directed to a composition comprising: a) 1-phenyl-5-mercaptotetrazole, an isomer thereof, a substituted phenyl mercaptotetrazole, or a salt thereof, preferably a water soluble salt thereof, and b) a compound selected from the group consisting of tolyltriazole, benzotriazole and salts thereof, wherein the weight ratio of a):b) ranges from about 0.1:100 to about 100:0.1. Such compositions are useful for inhibiting the corrosion of metals, particularly copper and copper-containing metals, in contact with an aqueous system.

The present invention is also directed to a method for inhibiting the corrosion of metals, particularly copper and copper-containing metals, in contact with an aqueous system comprising maintaining in the aqueous system being treated an effective amount, preferably at least about 0.1 ppm (parts per million) based on the weight of the ,water in the aqueous system being treated, of a composition comprising a) 1-phenyl-5-mercaptotetrazole, an isomer thereof, a substituted phenyl mercaptotetrazole or a salt thereof, preferably a water soluble salt thereof, and b) a compound selected from the group consisting of tolyltriazole, benzotriazole and salts thereof, wherein the weight ratio of a):b) ranges from about 0.1:100 to about 100:0.1.

The instant invention is also directed to an aqueous system which is in contact with a metallic surface, particularly a copper or copper alloy surface, which contains an effective amount of at least one of the instant compositions.

Compositions comprising water, particularly cooling water, and the instant compositions are also claimed.

The inventors have discovered that the instant compositions are effective corrosion inhibitors, particularly with respect to copper and copper-containing metals. These compositions provide improved passivation of metallic surfaces, particularly copper-containing surfaces, especially in high dissolved solids water. Since the compositions of this invention are especially effective inhibitors of copper and copper alloy corrosion, they can be used to protect multimetal systems, especially those containing copper or a copper alloy and one or more other metals.

The instant inventors have also discovered a surprising and beneficial interaction between phenyl mercaptotetrazoles and related compounds and one or more of tolyltriazole, benzotriazole and salts thereof. Aside from the fact that such compositions provide cost effective corrosion control in cooling water systems, these blends provide faster passivation rates than the components alone and are particularly effective when used to provide passivation in high dissolved solids, aggressive water.

The instant inventors have also found that the instant compositions de-activate soluble copper ions, which prevents the galvanic deposition of copper which concomitant occurs with the galvanic dissolution of iron or aluminum in the presence of copper ions. This reduces aluminum and iron corrosion. These compositions also indirectly limit the above galvanic reaction by preventing the formation of soluble copper ions due to the corrosion of copper and copper alloys.

Component a) of the instant compositions is selected from the group consisting of 1-phenyl-5-mercaptotetrazole (PMT), isomers thereof, substituted phenyl mercaptotetrazoles and salts thereof, preferably water soluble salts thereof. Isomers of PMT include tautomeric isomers such as 1-phenyl-5-tetrazolinthione and positional isomers such as 2-phenyl-5-mercaptotetrazole and its tautomers. Substituted phenyl mercaptotetrazoles include, but are not limited to, compounds wherein the phenyl group is $C_1$–$C_{12}$ (straight or branched) alkyl-, $C_1$–$C_{12}$ (straight or branched) alkoxy-, nitro-, halide- sulfonamido- or carboxyamido-substituted.

Component b) of the instant compositions is a compound selected from the group consisting of tolyltriazole (TT) and salts thereof, preferably sodium and potassium salts of TT, and benzotriazole (BT) and salts thereof, preferably sodium and potassium salts thereof. TT or salts thereof are preferred. The ratio, by weight, of component a):b) should range from about 0.1:100 to about 100:0.1, preferably from about 0.1:20 to about 20:1, and most preferably from about 5:1 to about 1:5.

An effective amount of one of the instant compositions should be used. As used herein, the term "effective amount" relative to the instant compositions refers to that amount of an instant composition, which on an active basis, effectively inhibits metal corrosion in a given aqueous system. Preferably, the instant compositions are added at an active concentration of at least 0.1 ppm, more preferably about 0.1 to about 500 ppm, and most preferably about 0.5 to about 100 ppm, based on the total weight of the water in the aqueous system being treated.

Maximum concentrations of the instant compositions are determined by the economic considerations of the particular application. The maximum economic concentration will generally be determined by the cost of alternative treatments of comparable effectivenesses. Cost factors include, but are not limited to, the total throughput of the system being treated, the costs of treating or disposing of discharge, inventory costs, feed-equipment costs, and monitoring costs. On the other hand, minimum concentrations are determined by operating conditions such as pH, dissolved solids and temperature.

Although any combination of a) 1-phenyl-5-mercaptotetrazole (PMT), an isomer of PMT, a substituted phenyl mercaptotetrazole and/or salt thereof and b) tolyltriazole, benzotriazole and/or salt thereof may be used, compositions having a component a):component b) weight ratio of from about 0.1:100 to about 100:0.1 are preferred. Ratios of from about 0.5:20 to about 20:0.5 are more preferred, and the most preferred weight ratios range from about 1:10 to about 10:1.

The preferred compounds used in the instant compositions are commercially available. For example, tolyltriazole and benzotriazole are commercially available from PMC, Inc., and PMT is commercially available from 1) Fairmount Chemical Co., Inc., 2) Aceto Corporation and 3) Triple Crown America, Inc. Generally, TT is sold as a sodium salt, while BT and PMT are sold as pure solids.

The instant compositions may be prepared by simply blending the constituent compounds. Suitable preparation techniques are well known in the art of water treatment and by suppliers of triazoles. For example, aqueous solutions may be made by blending the solid ingredients into water containing an alkali salt like sodium hydroxide or potassium hydroxide; solid mixtures may be made by blending the powders by standard means; and organic solutions may be made by dissolving the solid inhibitors in appropriate organic solvents. Alcohols, glycols, ketones and aromatics, among others, represent classes of appropriate solvents.

The instant method may be practiced by adding the constituent compounds simultaneously (as a single composition), or by adding them separately, whichever is more convenient. Suitable methods of addition are well known in the art of water treatment.

The instant compositions can be used as water treatment additives for industrial cooling water systems, gas scrubber systems or any water system which is in contact with a metallic surface, particularly surfaces containing copper and/or copper alloys. They can be fed alone or as part of a treatment package which includes, but is not limited to, biocides, scale inhibitors, dispersants, defoamers and other corrosion inhibitors. Also, while the instant compositions can be fed intermittently or continuously, continuous feed is preferred for optimal results. It is believed that compositions containing higher alkyl or alkoxy (i.e. $C_6$–$C_{12}$)-substituted phenyl mercaptotetrazoles are more suitable for intermittent feed.

Treatment of cooling water which contacts copper or copper alloy surfaces, such as admiralty brass or 90/10 copper-nickel, requires the use of specific copper inhibitors. These inhibitors:

1. minimize the corrosion of the copper or copper alloy surfaces, including general corrosion, dealloying and galvanic corrosion; and
2. minimize problems of galvanic "plating-out" of soluble copper ions onto iron or aluminum. Thus, soluble copper ions can enhance the corrosion of iron and/or aluminum components in contact with aqueous systems. This occurs through the reduction of copper ions by iron or aluminum metal, which is concomitantly oxidized, resulting in the "plating-out" of copper metal onto the iron surface. This chemical reaction not only destroys the iron or aluminum protective film but creates local galvanic cells which can cause pitting corrosion of iron or aluminum.

These objects are achieved through the use of the instant PMT/TT, or BT compositions, which quickly provide protective films on metallic surfaces, especially copper and copper alloy surfaces. These compositions are especially effective in the presence of chlorine and/or high dissolved solids.

EXAMPLES

Corrosion tests were conducted in water containing 3.0% by weight sodium chloride (18,200 ppm $Cl^-$) at 50° C. and a pH of 8.0 under full aeration. The corrosion rates shown in the tables were obtained using copper PAIR probes and are expressed in mils per year (mpy).

Corrosion rate data for the examples was obtained using an electrochemical method known as the Polarization Admittance Instantaneous Rate (PAIR) technique. By this technique, the metal of interest is polarized ±10 Mv and the current produced is measured The slight shift of the test electrode's potential is called "Linear Polarization". The current measured which produced the small polarization of 10 mv is proportional to the original, undisturbed corrosion current. The formula, developed by Stern & Geary is:

$$I_{corr} = \frac{I}{E} \times \frac{BaBc}{2.3\,(Ba + Bc)}$$

Where $I_{corr}$ is the current corresponding to the corrosion rate, I is the polarization current measured, E is the potential shift, Ba is the anodic Tafel slope, and Bc is the cathodic Tafel slope.

The relationship between corrosion rate (CR), the required polarizing current ( I) and the electrode potential shift ( E) is expressed by the basic PAIR equation:

$$CR^* = k\frac{I}{E}$$

*CR is in mpy.

Specimens were tested in a 3.0%, by Weight, NaCl solution at 50° C., with the pH adjusted to 8.0. Specimens were obtained from Metals Samples, Inc., Munford, Ala. The specimens were treated in the following way: oxide films were removed by immersing for 10–20 seconds in 35% nitric acid, and the specimens were then thoroughly rinsed using deionized (DI) water, followed by an acetone rinsing and air drying. Then the specimens were polished to a bright finish with a soft nylon pad. The sodium salt of tolyltriazole was used in these tests. Pure 1-phenyl-5-mercaptotetrazole was used.

The specimens contained 99.9% copper, by weight.

EXAMPLE 1

Table 1 shows the improved corrosion inhibition provided by a 1:1 admixture of PMT/TT compared to the inhibition provided by the individual components. The admixture gave lower corrosion rates than either TT or PMT alone. And after the prolonged exposure of 9 days, the mixture was still effective while the individual components had failed. In fact, PMT had failed with 48 hours.

TABLE I

Comparison of Copper Inhibitors: Copper Corrosion Rate in 3% NaCl, 50° C., pH 7.0

| Inhibitor | Instantaneous Corrosion Rates (mpy) | | | | |
|---|---|---|---|---|---|
| | 1 Hr. | 3 Hrs. | 20 Hrs. | 24 Hrs. | 48 Hrs. |
| Control | 18 | — | — | — | — |
| Tolyltriazole, Sodium Salt (5 mg/L) | 0.16 | 0.12 | 0.15 | 0.17 | — |
| TT (2.5 mg/L) Plus PMT (2.5 mg/L) | 0.04 | 0.05 | 0.04 | 0.04 | — |
| PMT (5 mg/L) | 0.6 | 0.4 | 0.6 | — | 7.5 |

EXAMPLE 2

This example compares the effectiveness of the TT/PMT admixture at pH 8.3, with other conditions being the same as in Example 1.

The results are shown in Table II. As can be seen in Table II, in the highly aggressive 3% NaCl, the admixture of PMT/TT both passivated the copper specimens more rapidly than the individual components and gave lower corrosion rates. The protection was not deteriorated even after 14 days exposure to the aggressive 3% NaCl solution.

TABLE II

Comparison of Copper Inhibitors: Copper Corrosion Rate in 3% NaCl, 50° C., pH 8.3

| Inhibitor | 1 Hr. | 2 Hrs. | 18 Hrs. | 20 Hrs. | 23 Hrs. | 48 Hrs. | 14 Days |
|---|---|---|---|---|---|---|---|
| Control | 18 | 20 | 19 | 19 | 19 | 19 | — |
| TT (5 mg/L) | 0.4 | 0.26 | 0.1 | 0.1 | 0.1 | 0.1 | 0.14 |
| PMT (5 mg/L) | 0.3 | 0.22 | 0.2 | 0.3 | 0.3 | 8.0 | 16 |
| 2.5 mg/L TT Plus 2.5 mg/L PMT | 0.08 | 0.07 | 0.04 | 0.04 | 0.05 | 0.04 | 0.07 |

What we claim is:

1. A composition which comprises a) a compound selected from the group consisting of 1-phenyl-5-mercaptotetrazole, isomers thereof, substituted phenyl mercaptotetrazoles and salts thereof; b) a compound selected from the group consisting of tolyltriazole, benzotriazole and salts thereof; and c) the water of an aqueous system in contact with a metal; wherein the weight ratio of a):b) ranges from about 0.1:100 to about 100:0.1 and wherein a) and b) are present at a dosage of at least about 0.1 ppm, based on the weight of c).

2. The composition of claim 1, wherein the weight ratio of a):b) ranges from about 1:100 to about 100:1.

3. The composition of claim 2, wherein the weight ratio of a):b) ranges from about 5:1 to about 1:5.

4. The composition of claim 3, wherein said metal is copper.

5. The composition of claim 2, wherein said metal is copper.

6. The composition of claim 5, wherein b) is tolyltriazole.

7. The composition of claim 1, wherein said metal is copper.

8. The composition of claim 7, wherein b) is tolyltriazole.

9. The composition of claim 1, wherein b) is tolyltriazole.

10. A method of inhibiting the corrosion of a metal in contact with an aqueous system comprising maintaining in said aqueous system an effective amount of a composition comprising a) a compound selected from the group consisting of 1-phenyl-5-mercaptotetrazole, isomers thereof, substituted phenyl mercaptotetrazoles and salts thereof and b) a compound selected from the group consisting of tolyltriazole, benzotriazole, and salts thereof; wherein the weight ratio of a):b) ranges from about 0.1:100 to about 100:0.1.

11. The method of claim 10, wherein the weight ratio of a):b) ranges from about 1:10 to about 10:1.

12. The method of claim 11, wherein at least about 0.1 ppm of said composition is maintained in said system.

13. The method of claim 12, wherein said metal is copper and wherein b) is tolyltriazole.

14. The method of claim 10, wherein the weight ratio of a):b) ranges from about 5:1 to about 1:5.

15. The method of claim 14, wherein at least about 0.1 ppm of said composition is maintained in said system.

16. The method of claim 10, wherein at least about 0.1 ppm of said composition is maintained in said system, based on the total weight of the water in said system.

17. The method of claim 10, wherein said metal is copper and wherein b) is tolyltriazole.

* * * * *